US007704128B1

(12) United States Patent
Staples et al.

(10) Patent No.: US 7,704,128 B1
(45) Date of Patent: Apr. 27, 2010

(54) TANK CLEANING SYSTEM AND METHOD

(76) Inventors: Wesley A. Staples, 4095 Silver Lake Dr., Palatka, FL (US) 32177-7978; Roscoe S. Rucker, 225 Glen Meadows Cir., Brunswick, GA (US) 31523

( * ) Notice: Subject to any disclaimer, the term of this patent is extended or adjusted under 35 U.S.C. 154(b) by 714 days.

(21) Appl. No.: 11/345,620

(22) Filed: Feb. 1, 2006

Related U.S. Application Data

(60) Provisional application No. 60/648,911, filed on Feb. 1, 2005.

(51) Int. Cl.
*B24B 23/00* (2006.01)

(52) U.S. Cl. ..... 451/350; 299/39.4

(58) Field of Classification Search ..... 451/350, 451/352; 299/39.4–39.8; 241/60, 101.72, 241/101.74, 101.762, 101.742
See application file for complete search history.

(56) References Cited

U.S. PATENT DOCUMENTS 5,645,232 A 7/1997 Staples et al.
6,733,086 B1 * 5/2004 McSharry et al. ..... 299/64

* cited by examiner

*Primary Examiner*—Robert Rose
(74) *Attorney, Agent, or Firm*—Allen, Dyer, Doppelt, Milbrath & Gilchrist, P.A.

(57) ABSTRACT

A tank cleaning apparatus is steered by an operator for cleaning the inside of a tank includes a connector operable with a vacuum removal system. The apparatus includes a cutter head that is rotationally driven to cut into settled solid material and to move the solid material to an area where suction from the vacuum system removes the material from the tank.

20 Claims, 15 Drawing Sheets

TANK CLEANING SYSTEM AND METHOD

CROSS-REFERENCE TO RELATED APPLICATIONS

This application claims the benefit of U.S. Provisional Application No. 60/648,911, filed Feb. 1, 2005, the disclosure of which is hereby incorporated herein in its entirety by reference.

FIELD OF THE INVENTION

The present invention relates to a tank cleaning apparatus especially suited for use with a vacuum removal system, and especially for use with vacuum truck systems.

BACKGROUND OF THE INVENTION

Vacuum trucks have come into common usage in the field of industrial cleaning. This field includes, for illustrative purposes, tank cleaning, cleaning of processing machinery, pits, open-areas, and, in some cases, spillage. Examples of vacuum truck systems that are designed for various end uses can be seen in U.S. Pat. Nos. 6,112,439; 5,195,852; and 4,200,950.

Many advances have been made in vacuum truck systems to improve their effectiveness and versatility in cleaning projects. The vacuum units themselves have seen improvements in suctioning power and the like.

In addition to general technological advances related to the actual vacuum system, accessories have been developed to increase the usefulness of the vacuum truck system, such as special sewer-service hoses and cleaning nozzles, containment boxes to receive vacuumed product, and receiving tanks for vacuum trucks which are capable of elevating and dumping material.

Notwithstanding that vacuum trucks are known to be suitable for use in tank cleaning, and notwithstanding the rather substantial investment required to acquire a vacuum truck system and one or more of the noted accessories, there has been essentially no effort to provide means disposed in the tank itself for more efficiently using a vacuum truck in tank cleaning operations. The "in tank" equipment commonly employed includes a traditional vacuum hose with a stick taped to it with masking tape, so that the stick can be moved through settled solid or semi-solid material to break up the material, which is then vacuumed away by the hose. In addition, picks, shovels, and rakes have been brought into the tank being cleaned to handle and move material to be vacuumed through the hose.

A principal advantage in using a vacuum truck system for cleaning is that the system rapidly moves material when it is introduced into the vacuum hose. Heretofore, in tank cleaning operations, the full effectiveness of a vacuum truck system has not been attained. The manual process of breaking up and moving the material to the vacuum hose with sticks, picks, shovels or rakes is slow, and the vacuum truck system is capable of handling and removing much more material than is manually prepared for removal by the vacuum system.

It is therefore a principal object of the present invention to provide an apparatus to be used inside a tank in a tank cleaning operation which utilizes a greater amount of the capacity of a vacuum removal system.

It is a further important object of the present invention to provide a tank cleaning apparatus that replaces most manual efforts in preparing material in the tank for removal by a vacuum removal system.

SUMMARY OF THE INVENTION

The above and other objects of the present invention are attained by providing a tank cleaning apparatus constructed in a manner so as to be capable of being placed into a tank to be cleaned, with the apparatus having a connector designed to have a traditional vacuum hose from a vacuum removal system connected or coupled thereto. The tank cleaning apparatus is a wheeled unit, either steered by an operator standing behind the unit, or steered by an operator riding on a sulky provided at the rear of the unit.

The tank cleaning apparatus has a cutterhead that is rotationally driven to cut into settled solids and to move those solids to an area where the suction of the vacuum truck external to the tank can operate to remove the material from the tank. Various devices and controls in and around the cutterhead subassembly are provided to aid in providing a more efficient and effective material breakup and moving operation tailored to the characteristics of the particular vacuum truck system in use and tailored to the particular media being cleaned out of a given tank.

BRIEF DESCRIPTION OF THE DRAWINGS

The above and other aspects of the present invention will be more clearly understood from the ensuing detailed description of the preferred embodiments of the present invention, taken in conjunction with the drawings, in which like reference numerals are used to refer to like elements throughout the several views, and wherein.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
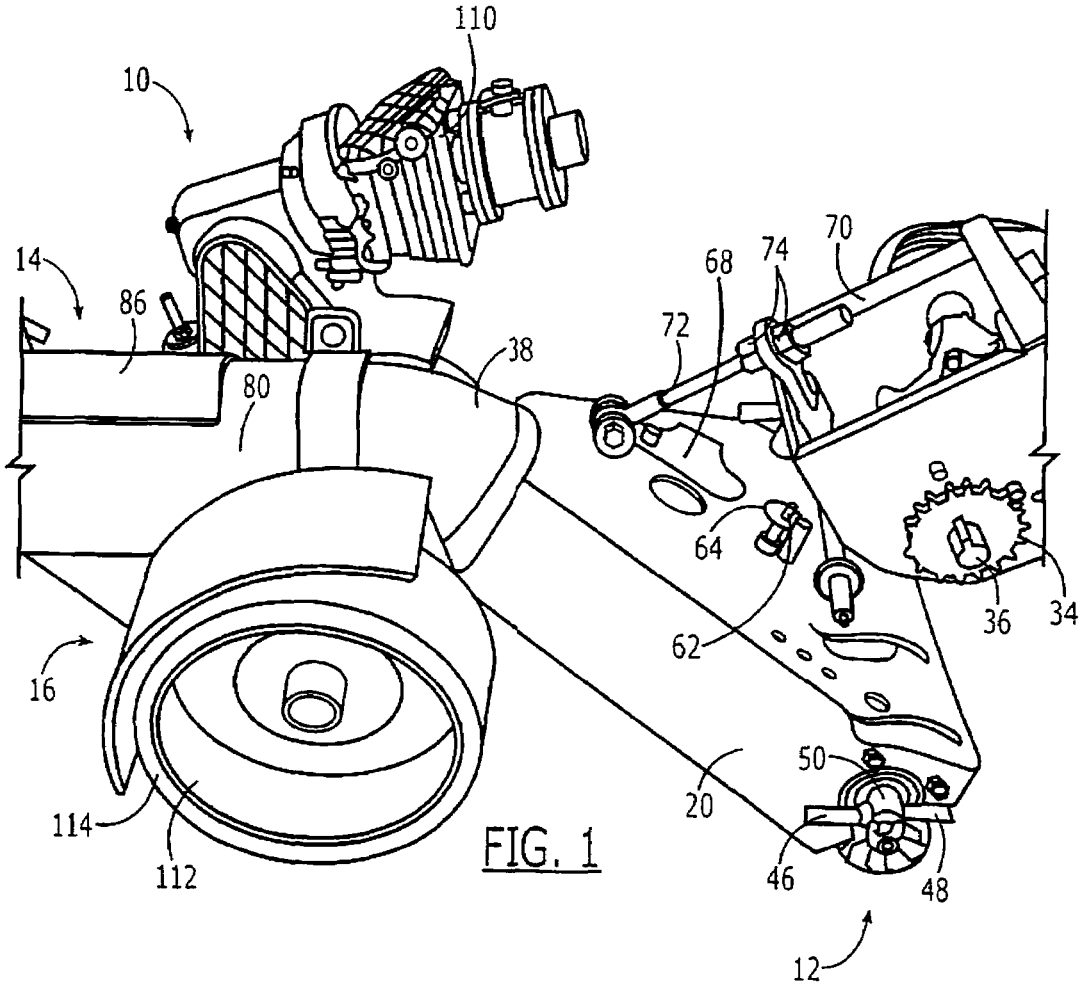
FIG. 1 is a perspective view of the lower portion of the tank cleaning apparatus in accordance with a preferred embodiment of the present invention.
Figure 2:
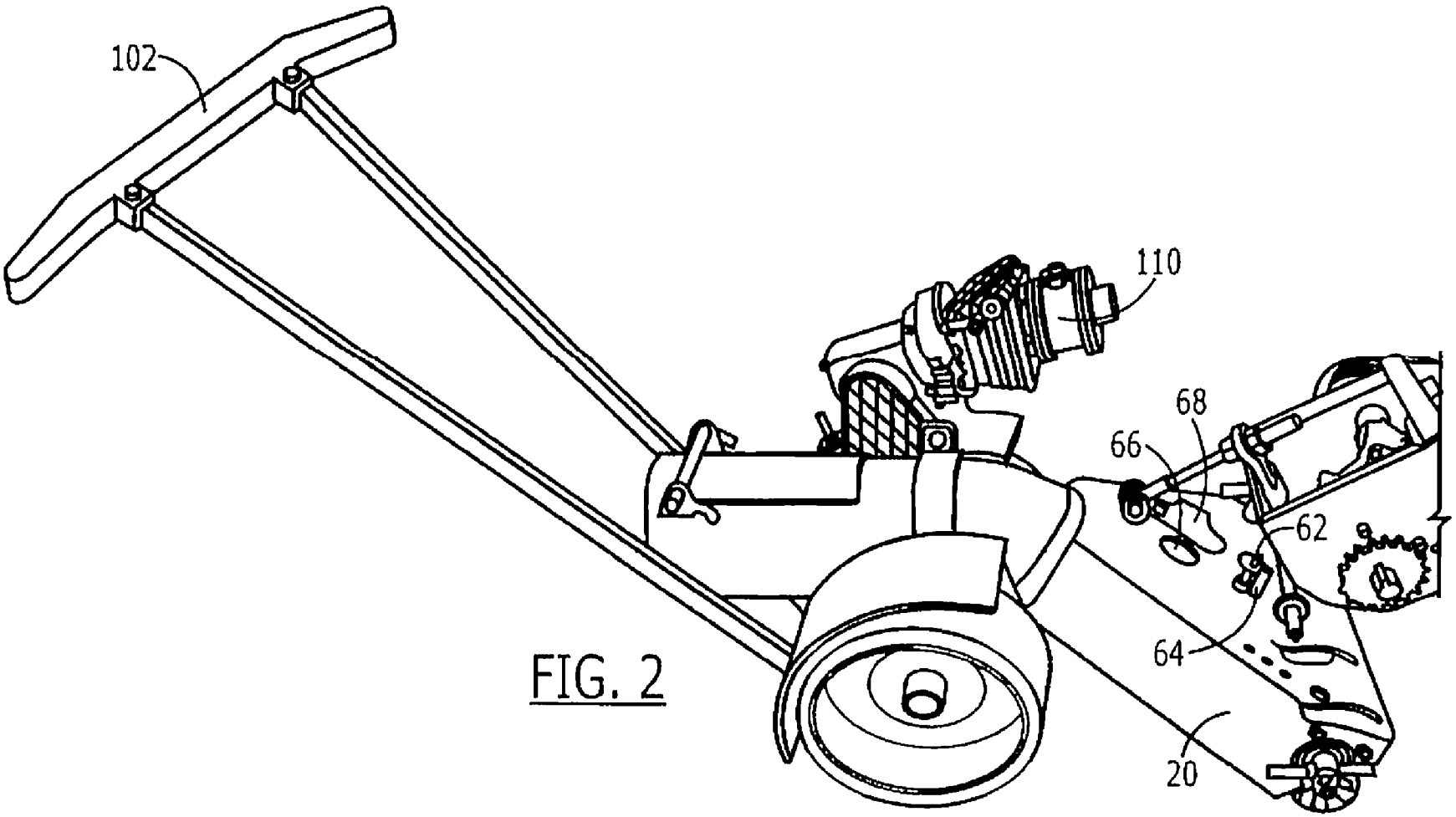
FIG. 2 is a perspective view of the tank cleaning apparatus in a partially assembled condition.
Figure 3:
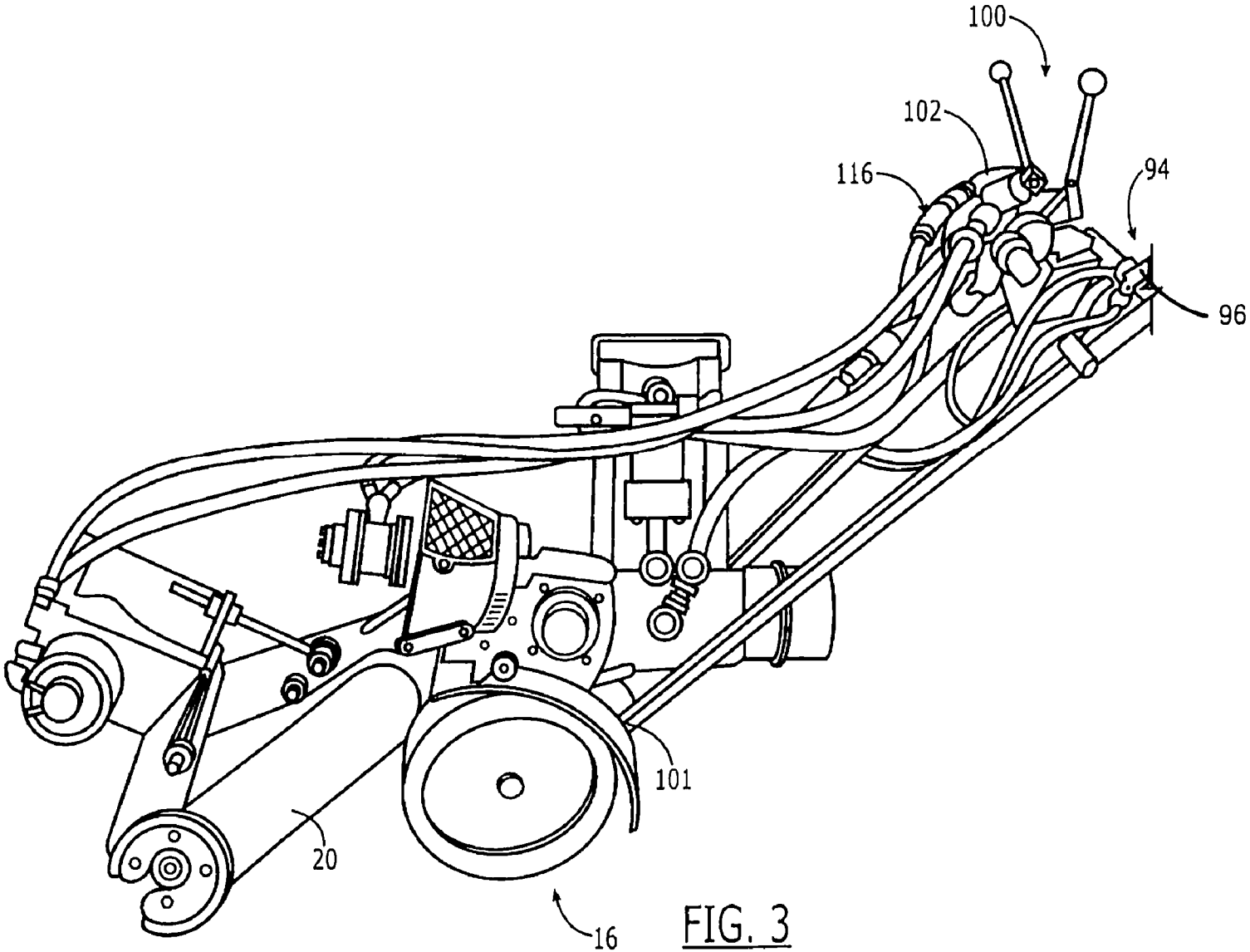
FIG. 3 is a side perspective view of the tank cleaning apparatus in accordance with a preferred embodiment of the present invention.

Referring initially to FIGS. 1-3, the tank cleaning apparatus or assembly 10 in accordance with a preferred embodiment of the invention is shown. The tank cleaning assembly 10 has a cutterhead assembly 12, an air tube subassembly 14 and a propulsion subassembly 16.

It is to be noted at the outset that while the detailed description of the invention will make reference to a vacuum truck system, the apparatus of the present invention is designed to be capable of being used with other vacuum or suction removal systems, including stationary units.

The cutterhead subassembly 12 comprises a housing 20 having a cutting bar 22 (see also FIG. 5) disposed at a forward end thereof. Cutting bar 22 comprises a transversely mounted center shaft 24 provided with a plurality of cutting teeth 26 spaced apart across the lateral extent of the center shaft. The cutting teeth 26 extend substantially radially outwardly from the center shaft 24 at varying angles of orientation (when the shaft is viewed end-on). The cutting teeth 26 may be oriented in a pattern approximating a helix or a double helix, or any other desired pattern, or may be randomly positioned around center shaft 24. Cutting teeth 26 are preferably made from sections of steel or aluminum bar stock, and may be attached to center shaft 24 by welding or other suitable securing means, such as by bands extending around the shaft, or being secured in keyed shots provided on the shaft.

Figure 4:
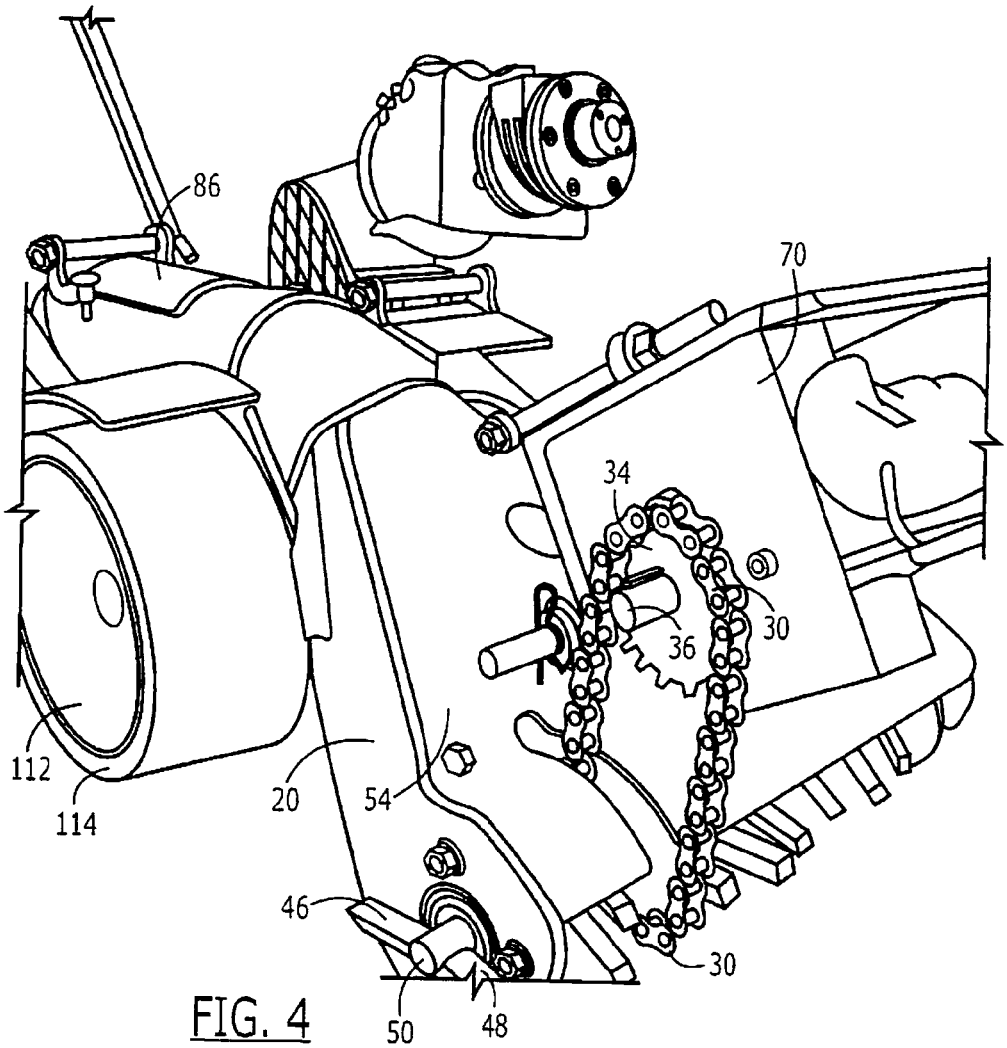
FIG. 4 is another perspective view of the lower portion of the tank cleaning apparatus in accordance with a preferred embodiment of the present invention.
Figure 5:
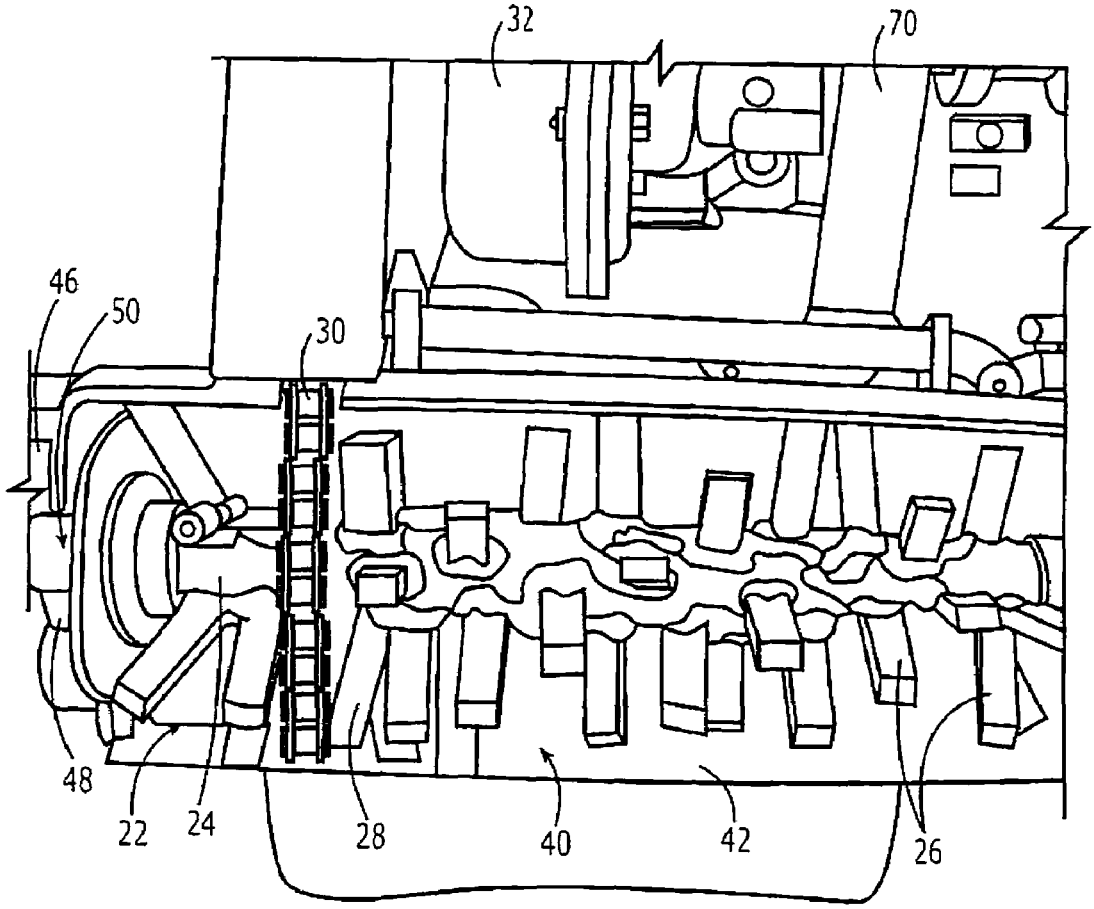
FIG. 5 is a bottom elevation view of a cutterhead subassembly in accordance with a preferred embodiment of the present invention.

A driven gear or sprocket 28 is also secured onto center shaft 24, such that the center shaft can be rotationally driven by drive chain 30, which is in turn driven by cutting motor 32, having a drive gear 34 secured to its output shaft 36 (FIGS. 1, 4, 5). The operation of cutting motor 32 is controlled by an operator via suitable controls 100 (FIG. 3) the design of which would be well known to persons of ordinary skill in the art.

The housing 20 of cutterhead subassembly 12 may preferably be substantially wedge-shaped, with an internal cross-section of rectangular shape decreasing in cross-sectional area from the area at which the cutterhead is positioned, upwardly to a juncture with transition member 38 at its upper (or rearward) extent. The transition member assumes a substantially circular cross-section sized to essentially approximate the cross sectional dimension of a vacuum tube to be connected to the tank cleaning assembly 10.

Figure 6:
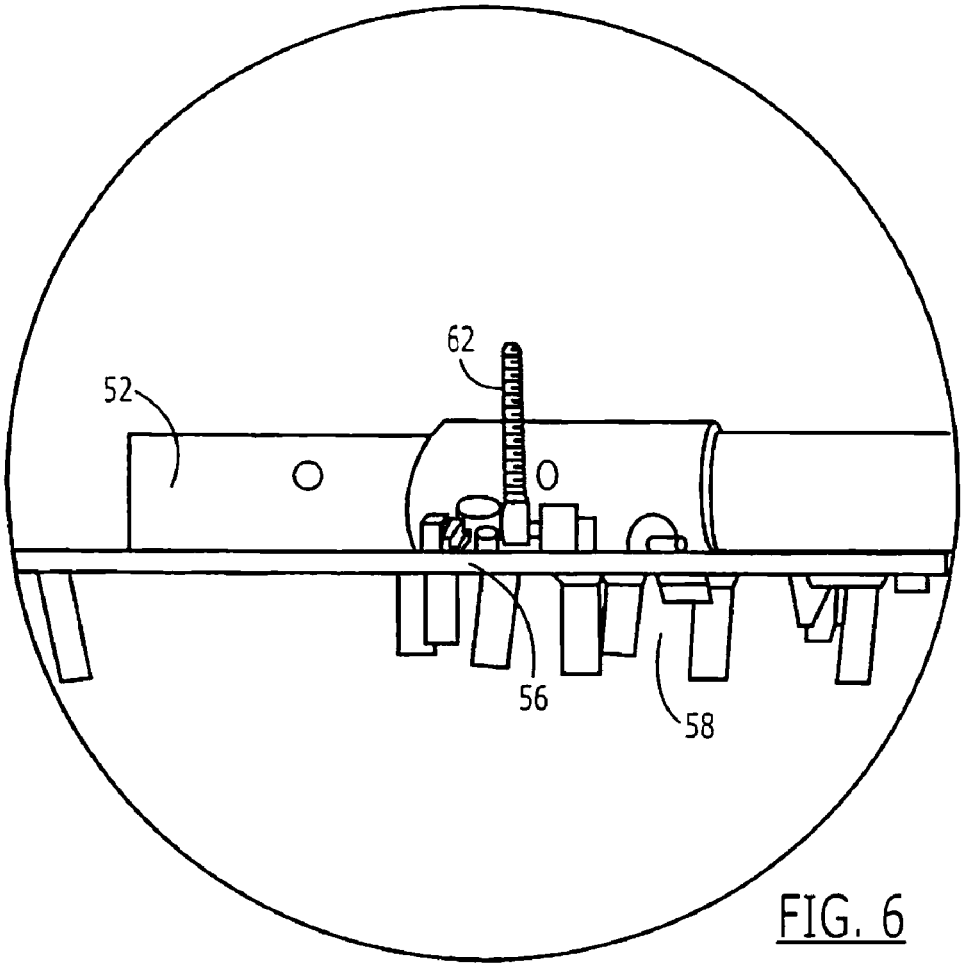
FIG. 6 is a plan view of an interior of a cutterhead subassembly in accordance with a preferred embodiment of the present invention.
Figure 7:
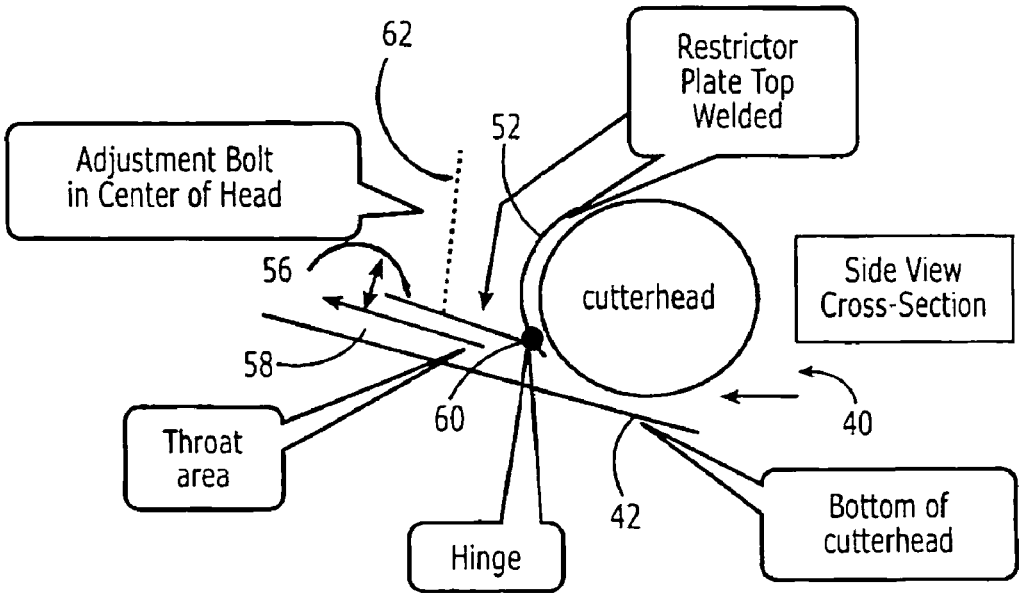
FIG. 7 is a schematic side view of an interior of a cutterhead subassembly in accordance with a preferred embodiment of the present invention.

As can be seen principally in FIGS. 5, 6, and 7, the cutting bar 22 is mounted in cutter head subassembly 12 in a position at which a forward portion of the cutting bar is exposed at an opening 40 at the terminal end of cutterhead subassembly 12. When driven by the drive chain and cutting motor, the cutting bar 22 rotates and cutting teeth 26 are able to break up material in a tank being cleaned, and move or thrust that material onto and over a skiver blade 42 provided at a forward edge of the lower side of cutterhead assembly 12.

Positioned laterally of housing 20 on cutterhead subassembly 12 are two material clearing or flipper blade assemblies 44. The clearing blade assemblies, as illustrated, having diametrically opposed flippers 46, 48 extending from a central hub 50. Central hub 50 on each assembly is secured to center shaft 24 by being threaded into a threaded opening at each terminal end of shaft 24. It would alternatively be possible to provide central shaft in a length that would extend laterally from housing 20, such that the flippers 46, 48 could be secured directly thereto, as by welding.

The cleaning or flipper blade assemblies 44 rotate as shaft 24 is driven, and operate to cut away the material inside the tank adjacent to the terminal end of cutterhead subassembly 12. This facilitates the further advancement and penetration of cutterhead subassembly 12 into the material being cleaned from or removed from the tank, by reducing or eliminating any binding or other resistance at the sides of the cutterhead assembly.

In the interior of housing 20 of cutterhead subassembly 12, an arcuate shroud 52 (FIG. 7) is provided adjacent to the cutting bar 22, to prevent of material being carried in cutting teeth 26 from being thrown into the cutterhead subassembly in an uncontrolled manner as the teeth rotate back toward the opening at the forward end of the cutterhead subassembly. The shroud will preferably be secured to the interior of an upper wall 54 of housing 20, as by welding, bolting, or any other suitable securing means.

At a lower extent of shroud 52, a forward edge of a restrictor plate 56 (FIGS. 6, 7) is secured thereto in a hinged manner. Restrictor plate preferably has a shape that is complementary to the tapered shape of the housing, such that lateral edges thereof are closely spaced from the side walls of the housing.

The restrictor plate 56 creates a throat area 58 within housing 20, such that the cross-sectional area through which material is moved from the cutter bar to (eventually) a collection container associated with the vacuum truck unit may be adjusted as desired. In the illustrated preferred embodiment, restrictor plate 56 is joined to shroud 52 by a hinge mechanism 60. An adjustment bolt 62 is connected to an upper surface of restrictor plate 56, and extends upwardly through an opening in upper wall 54 of housing 20, where a threaded adjusting nut 64 is coupled to bolt 62. This will allow the operator to raise and lower restrictor plate 56 to adjust the cross-sectional area through which material removed from the tank will be advanced.

Having the ability to control and adjust the cross-sectional area at the location behind cutting bar 22 is seen as being especially advantageous when using this device with a vacuum truck system, in that this is the area or region within housing 20 and cutterhead subassembly 12 where movement of the material generally transitions from being physically advanced by additional material being moved rearwardly by the cutter teeth 26, to being suctioned out through cutterhead subassembly 12 by and toward the vacuum unit.

The restrictor plate may preferably be adjusted to provide an opening having a cross-sectional area approximating a cross-sectional area of a vacuum hose used. In situations in which a greater or lesser amount of suction force is available from the vacuum system, the position of the restrictor plate can be changed to create a smaller or larger cross-sectional opening, as desired, to obtain an optimal working environment. The type and consistency of the material being cleaned from a particular tank may also have an effect on the desired amount of suction power experienced in the cutterhead subassembly, and the restrictor plate can be adjusted accordingly to provide the desired level of suction. In general reducing the area through which the material can pass will increase the vacuum or suction power.

Upper wall 54 of housing 20 may also preferably have a vent comprising an opening 66 on the order of one inch to several inches in diameter therein, with a pivotable door 68 sized to be able to fully close off the opening 66, or to allow the opening 66 to be fully open, or to partially close off the opening 66 to any desired degree. This vent feature may be used to control the amount or volume of airflow permitted to enter the cutterhead subassembly 12. This operator-adjustable vent may be used to ensure that an adequate amount of free air enters the system at the cutterhead to avoid clogging of material in the system as it is removed from the cutterhead. The proper sizing of this vent will be well within the skill of the ordinary person skilled in the art. The setting of the position of the door will be made by the operator based on the particular operating conditions present, for example, the type of material being processed, and the suction power provided by the particular vacuum unit being used.

As noted previously, a cutting motor 32 is provided to drive cutting bar 22. Cutting motor 32 is preferably mounted atop upper wall 54 of the cutterhead subassembly 12 in a motor housing 70 that is pivotably attached to the upper wall 54. The orientation of housing 70 may be adjusted by motor adjustment bolt 72 and nut 74, with motor adjustment bolt 72 itself being pivotably secured to upper wall 54.

The pivoting of housing 70 toward upper wall 54 moves drive gear 34 closer to driven gear 28 so that the drive chain 30 may easily be removed from drive gear 34 when the cutter bar 22 is to be removed from cutterhead assembly, for maintenance or repair. In addition, the positions of the drive and driven gear may be adjusted to tighten the chain around the drive and driven gear, as necessary. If conditions warranted, the adjustment could be used to produce a predetermined amount of slack in the chain.

As noted previously, cutterhead subassembly 12 has a transition member 38 at its rearward end, preferably connected thereto by a weldment. Transition member 38, which has a substantially circular cross-section, is connected in a substantially airtight manner to an air tube subassembly 14.

These components are mounted on a carriage 101 of the propulsion subassembly 16.

The air tube subassembly 14 comprises a substantially cylindrical tube member 80 having a vacuum hose connector 82 at a rearward end thereof. Air tube subassembly 14 is provided with a large vent opening 84 through the wall of the tube and a pivotable flap 86 disposed to completely cover the vent opening 84. Flap 86 may preferably be mounted to an outer surface of tube member 80 by a pair of brackets 88 secured to the tube member 80 and a pivot pin 90 extending through openings in the bracket and a sleeve 92 secured to flap 86.

Figure 8:
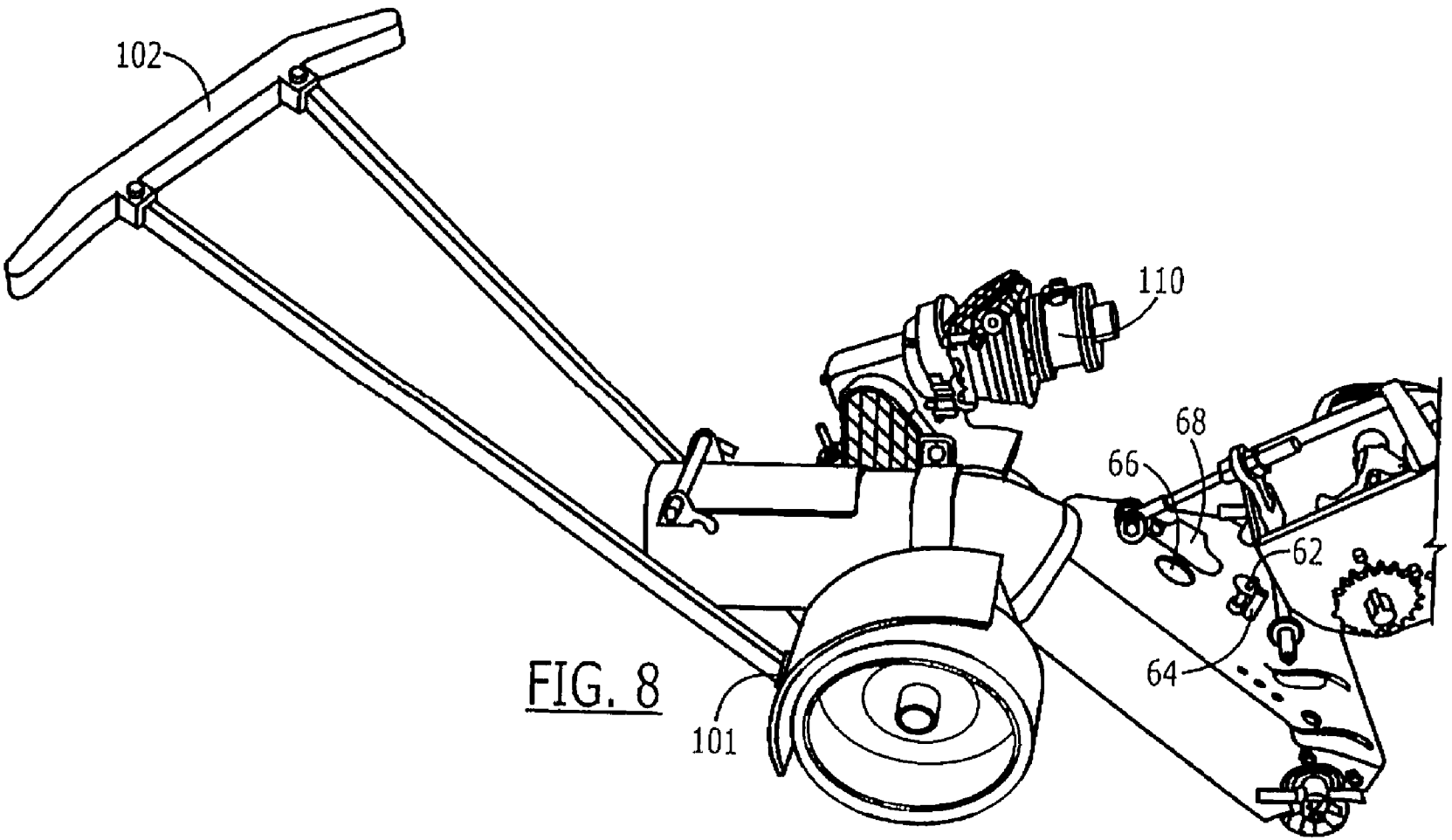
FIG. 8 is a side view of an air tube subassembly portion of the lower portion of the tank cleaning apparatus, with a flapper valve in a closed position.
Figure 9:
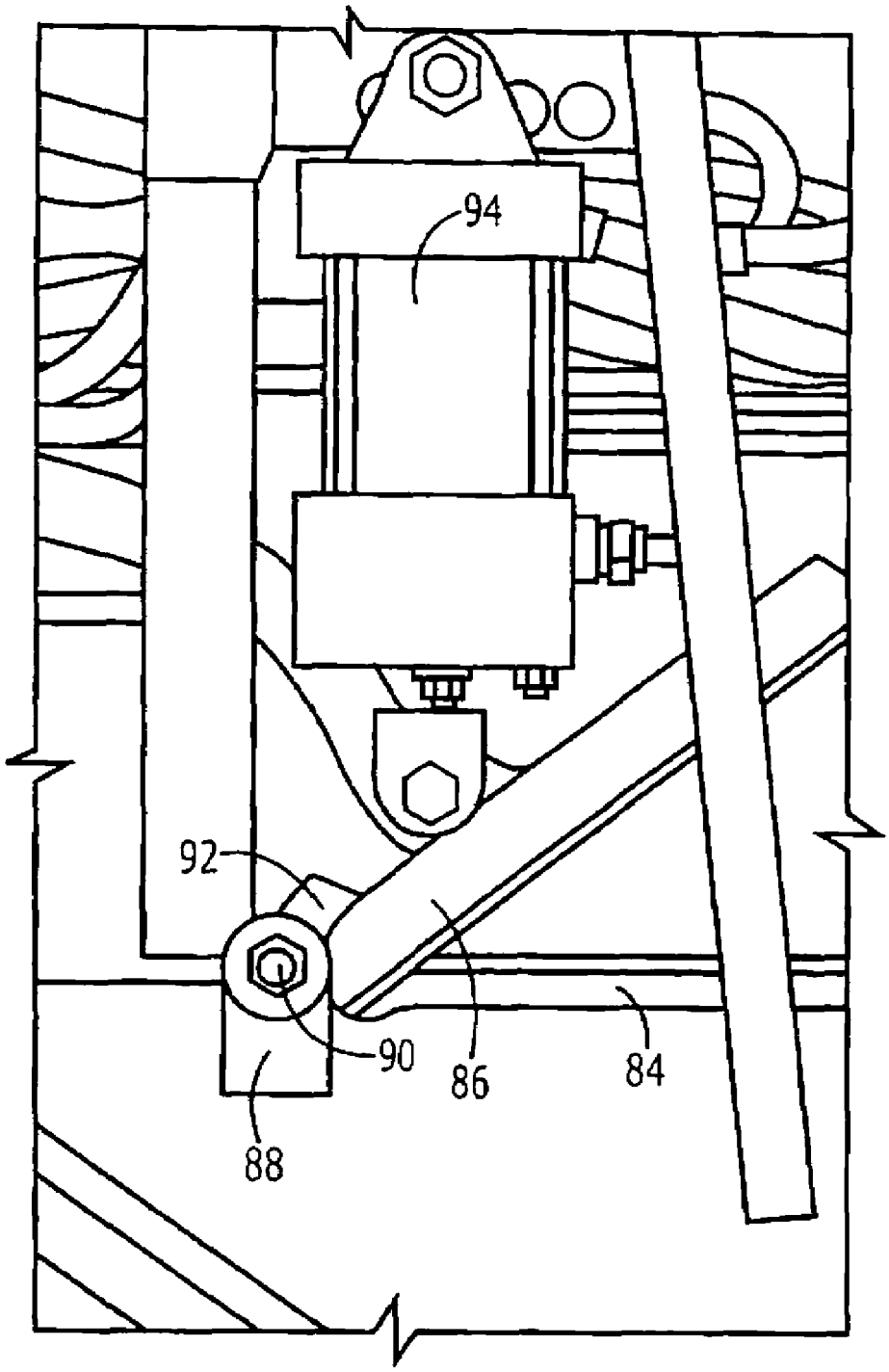
FIG. 9 is a side view of an air tube subassembly portion of the lower portion of the tank cleaning apparatus, with a flapper valve in an open position.

The flap may preferably be movable between a closed position covering vent opening 84 (referring to FIG. 8) and an opened position in which the flap is raised up from the vent opening (referring to FIG. 9). The opening and closing of the flap 86 is preferably controlled by the operator via a pneumatically controlled cylinder assembly 94 mounted to carriage 101. The use of a pneumatically controlled cylinder allows the flap 86 to be opened and closed quickly, which provides the operator with the ability to reasonably accurately control the amount of air let into the vacuum system. A pushbutton 96 is positioned at the operator handle 102 on carriage 101, to allow the operator to activate the cylinder assembly to open the flap while the unit is in operation.

The provision of a large (on the order of one to several square feet in area) vent opening is regarded as being an important feature in effectively and efficiently utilizing a vacuum system in a tank cleaning operation. The vacuum hose 200 (FIG. 10) which is coupled to the tank cleaning assembly works most efficiently when it is allowed to "breathe", meaning that free air must be introduced into the hose. The vent opening 66 and door 68 positioned on the cutter head assembly 12 are generally used to provide a constant small volume of air to be supplied to the vacuum system. However, the material being cleaned from industrial tanks frequently has high levels of solids therein, as the material being removed is principally solids or dense liquids that have settled to the bottom of the tank over a period of time. In such situations, even with the cutting teeth breaking up the material and feeding it through the cutterhead assembly, a substantial risk of frequent clogging is posed when handling this type of material. In addition, the dense nature of the material makes it difficult for the vacuum unit, which is positioned a considerable distance away from the tank cleaning assembly, to effectively suction the material at a fast rate.

Accordingly, the vent opening 84 and flap 86 allow the operator to provide surges of high volumes of air to enter the system periodically to aid in clearing the material through the hose to the collection unit of the vacuum system. While the vent opening 84 and flap 86 are preferably disposed on air tube subassembly 14 in the depicted embodiment, it would be possible to position these components at other locations on the unit, whether on the air tube subassembly or the cutterhead subassembly, or on some other component which is in fluid communication with the vacuum hose.

The tank cleaning assembly 10 is preferably propelled by a pneumatic motor 110 mounted on carriage 101. Motor 110 is operatively coupled to a pair of wheels 112 having solid rubber tires 114 mounted thereon, which are positioned to either side of air tube subassembly 14 on an axle (not shown) mounted to carriage 101. Alternatively, a hydraulic system could be employed. In either case, the detailed design of this propulsion system will be well known to persons of ordinary skill in the art. Propulsion controls 116 may be mounted on handle 102, to place them within easy reach of the operator.

The tank cleaning apparatus 10 as illustrated in FIGS. 2 and 3 may be operated by a person positioned behind the unit who will advance the unit across the floor of a tank using propulsion controls 116. It is envisioned that the apparatus 10 will be operated in this manner when the tank is first entered, in order to enable the operator to clear out an initial working area on the tank floor. In addition, other conditions such as the tank being relatively small, or the presence of various types of material and/or quantity of material buildup, may favor use of the apparatus with the operator standing and walking behind or beside the unit.

Figure 10:
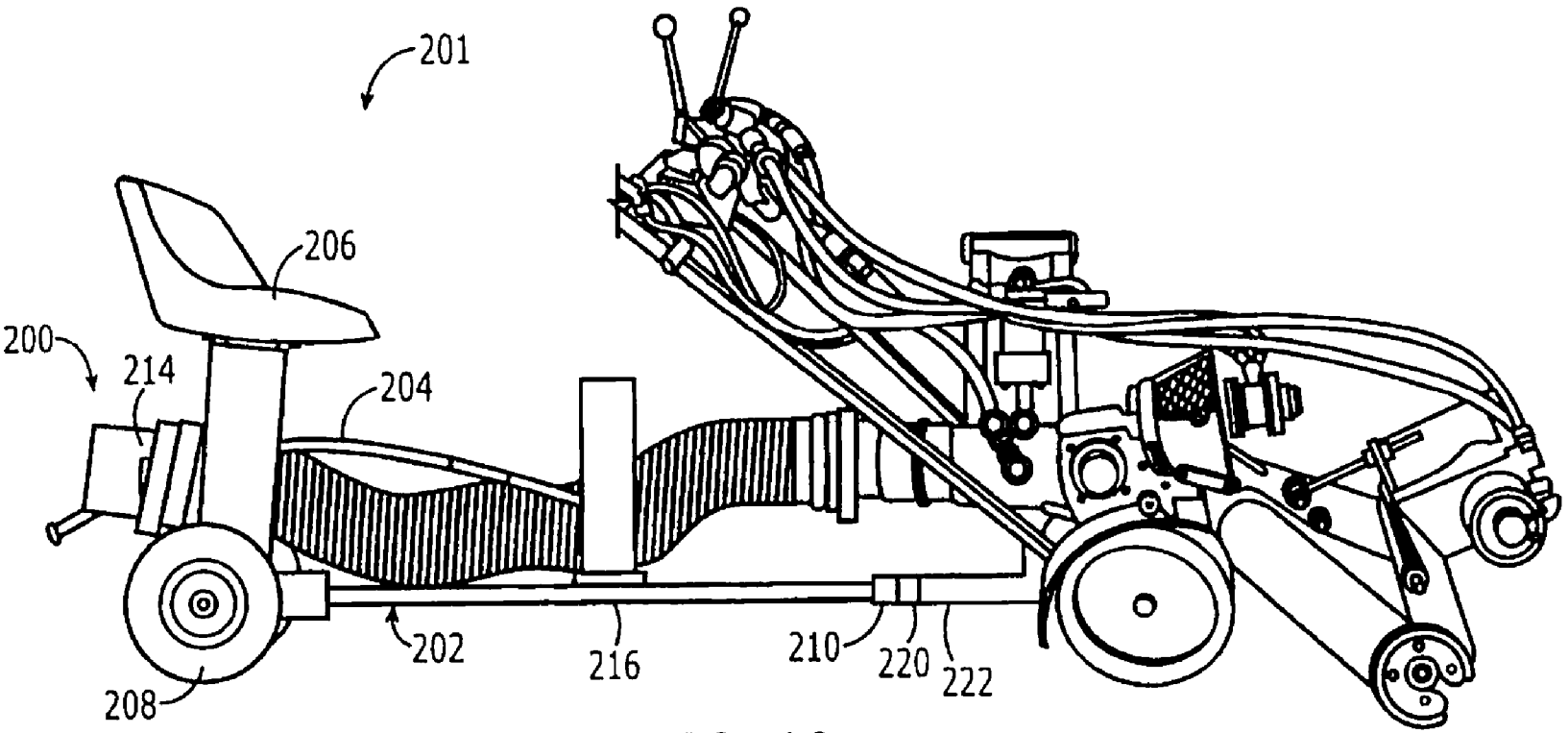
FIG. 10 is a side perspective view of the tank cleaning apparatus in accordance with another preferred embodiment of the present invention.
Figure 11:
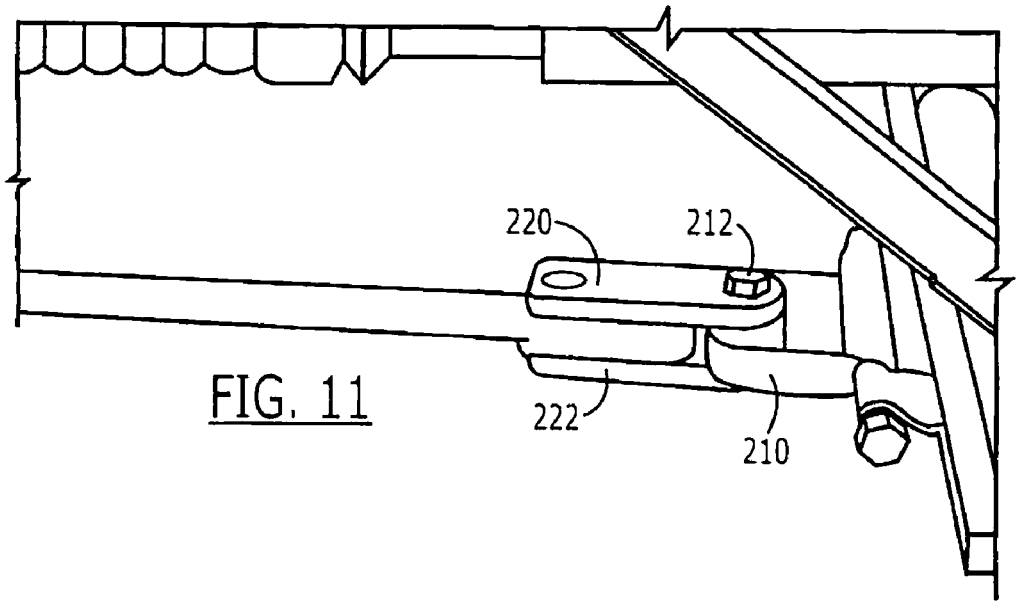
FIG. 11 is a close-up side view of the sulky connection in accordance with a preferred embodiment of the present invention.
Figure 12:
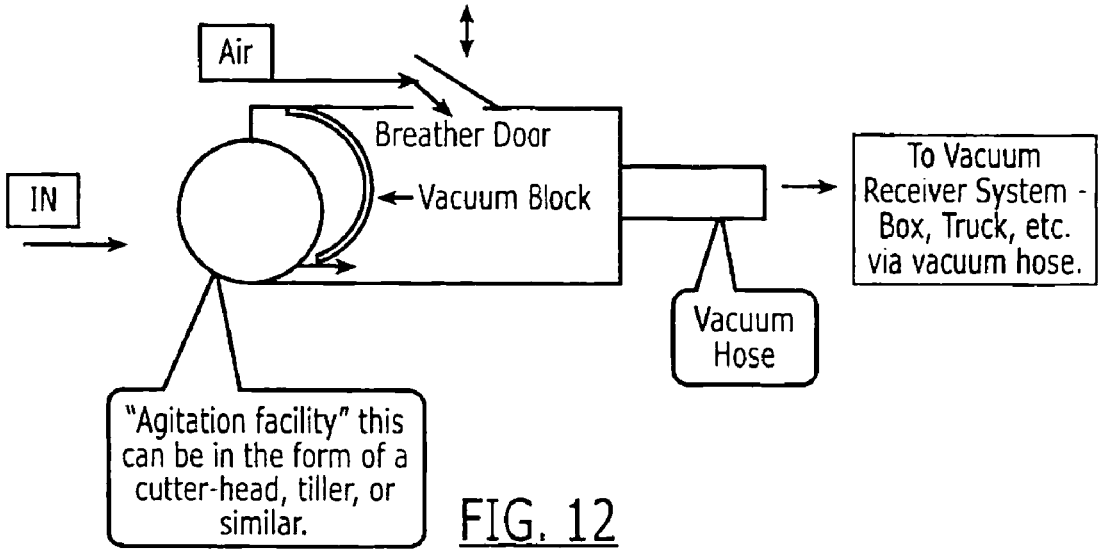
FIG. 12 is a diagrammatical side view of one embodiment of a vacuum system in keeping with the teachings of the present invention.

FIG. 10 illustrates a further aspect of a preferred embodiment of the invention. In this embodiment, carriage 101 is coupled to a sulky 201 comprising a frame 202, a seat support 204, a seat 206, and a pair of wheels 208 (one shown). The coupling of sulky 201 to carriage 101 is preferably effected in a manner such that the two elements can pivot relative to one another about the coupling. Suitable types of couplings will be well known to persons of ordinary skill in the art. One possible suitable coupling would involve the provision of a tongue 210 at a lower, rear portion of carriage 101, which is adapted to be sandwiched between upper and lower attachment plates 220, 222 on sulky 101. The tongue and attachment plates preferably have bores extending therethrough to receive a coupling pin 212, thereby forming a pinned connection. Such a connection enables a quick coupling end decoupling of the sulky to the carriage in a simple manner, such that these operations can easily be performed within the confines of the tank.

Sulky 201 is preferably configure to support a suction hose from the external vacuum unit, or a suction hose extension 214 that is operable to couple the suction hose (not shown) to the air tube assembly 14. A support bracket 216 may preferably be provided surrounding suction hose extension 214 (or the suction hose itself, when no extension is used), which supports the suction hose extension 214 from underneath to keep it from sagging toward the tank floor, and which provides lateral constraints to maintain the suction hose extension in general alignment with the longitudinal extent of sulky 201. Seat support 204 also forms an open passageway therethrough to provide similar lower support and lateral constraint. A support rod (not shown) may be provided to extend rearwardly of sulky 201 for a couple to several feet, in order to keep the suction hose out of the way of the sulky when the assembly is operated in reverse.

The sulky 201 may preferably include a safety switch coupled to seat 206, which would operate to block air flow from the cutterhead assembly through to the external vacuum unit when there is no (or little) weight bearing down on seat 206, indicative of the absence of an operator. The switch would operate to reestablish air flow once an operator sits on the seat.

The use of sulky 201 renders the unit somewhat less maneuverable, however, allowing the operator to sit down while operating the unit is expected to improve productivity by the operator, particularly where elevated temperatures are experienced inside the tank to be cleaned.

It has previously been discussed that air (pneumatics) is preferred for use as a power source for propulsion and other controls/operations. Pneumatic systems employing air are generally clean and are non-sparking, which can contribute to increased safety when cleaning volatile materials from a tank. In addition, air hose is inexpensive compared to hydraulic hose, and the overall cost of operation of a pneumatic system is generally less than that of a hydraulic system.

A disadvantage of pneumatic systems is that air motors tend to be noisy. In the present invention, it is envisioned that the potential noise problem can be minimized or abated by venting the discharge of the air motors into the vacuum hose. This is expected to increase the noise level of the vacuum system to a degree, but will reduce the overall level of noise generated. The above discussion and the associated drawing figures address one or more preferred embodiments of the present invention. These are not intended to limit the scope of the invention, and are provided for illustrative purposes only.

As illustrated, by way of example, with reference to the above diagrammatical illustration, one embodiment of the invention may be described as including a system that joins vacuum and cutter-head/tiller technologies. A vacuum system has facilities to agitate a substance just prior to its entry, which agitation assists that entry into the vacuum system. A "receiving chamber" provides a "Vacuum Box" styled chamber to accept dry and liquid vacuumed materials. The chamber is such to encourage the materials to enter a "rotary discharging seal" to remove the material from the vacuum system for transport through a pipeline or trucks, by way of example. This would apply to both liquids and solids.

The "agitation facility" may be in a number of forms including hand-held, walk-behind, skid-steer riding the operator, steered riding the operator, and track-driven riding the operator. Additionally, such units may be remote controlled without an operator in conditions where that is an advantage or requirement.

Embodiments may include a combination or sub-combination of a skiving blade under the cutter-head, a breather to allow the addition of air to clear the vacuum hose, variations of the cutter-head style, vacuum blocks, and the like. Various Power sources may be used.

A "lead lined" cabinet with it accessories for using the "Vacuvator" (tank cleaning system and method) in a nuclear tank cleaning field may also be included. Yet further, embodiments may include a hand-held, walk-behind, and track riding apparatus. Anticipated uses include but will not be limited to the Industrial, Nuclear, and Crude oil fields.

Since our entry into the nuclear age more than a half century ago we have been accumulating nuclear waste as a result of production for the energy and defense industries. We read continually of the problems and need to clean up these waste sites. We sometime wonder how serious our government is about solving the problem, or how the MO promotes negative results to propagate jobs and positions.

Never-the-less, we understand there are several hundred large tanks that contain this waste and need attention now. We read reports of leakage into the ground water and concrete underground pits as a result of this leakage. With the technique of glass encasement now in use, many times it is the problem of recovering the radiated waste from these storage areas that is the holdup. The technology that is unveiled herein, we feel, is an answer to a large part of that problem.

We understand that at several locations within the U.S. there are facilities with 50 or more of the type tanks described below. These are carbon steel tanks constructed some 50 years ago. They are bunkered underground surrounded by concrete walls and sub-floors. They are toxic with Alpha, Beta, and Gamma radiating nuclear waste. These tanks are some 85 feet in diameter and contain sludge buildups of 4-6 feet. Each vertical foot contains 42,445 gallons of sludge. It would be fatal for any human to enter one of these storage areas. Removal of the manway covers on one of these tanks will set off alarms for several miles. As these tank conditions worsen and the leakage increases, management has made the decision to clean the tanks of nuclear contaminated sludge and fill the area with grout. To date complete cleaning of the tanks has not been achieved.

This sludge resembles muddy silt-like textured material and its harmful radiation can last for several hundred years. For this reason, all the contaminated material needs to be removed prior to closing the facility.

Figure 13:
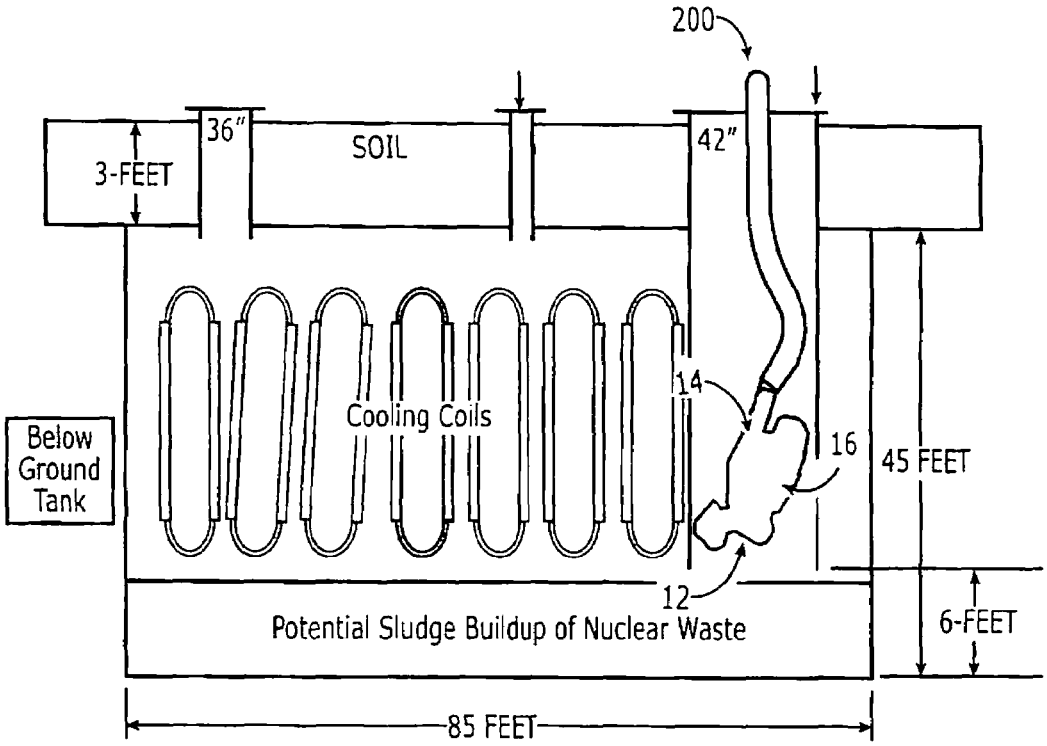
FIG. 13 is a diagrammatical elevation view illustrating one embodiment of the present invention operable with a storage tank containing nuclear waste material.
Figure 14:
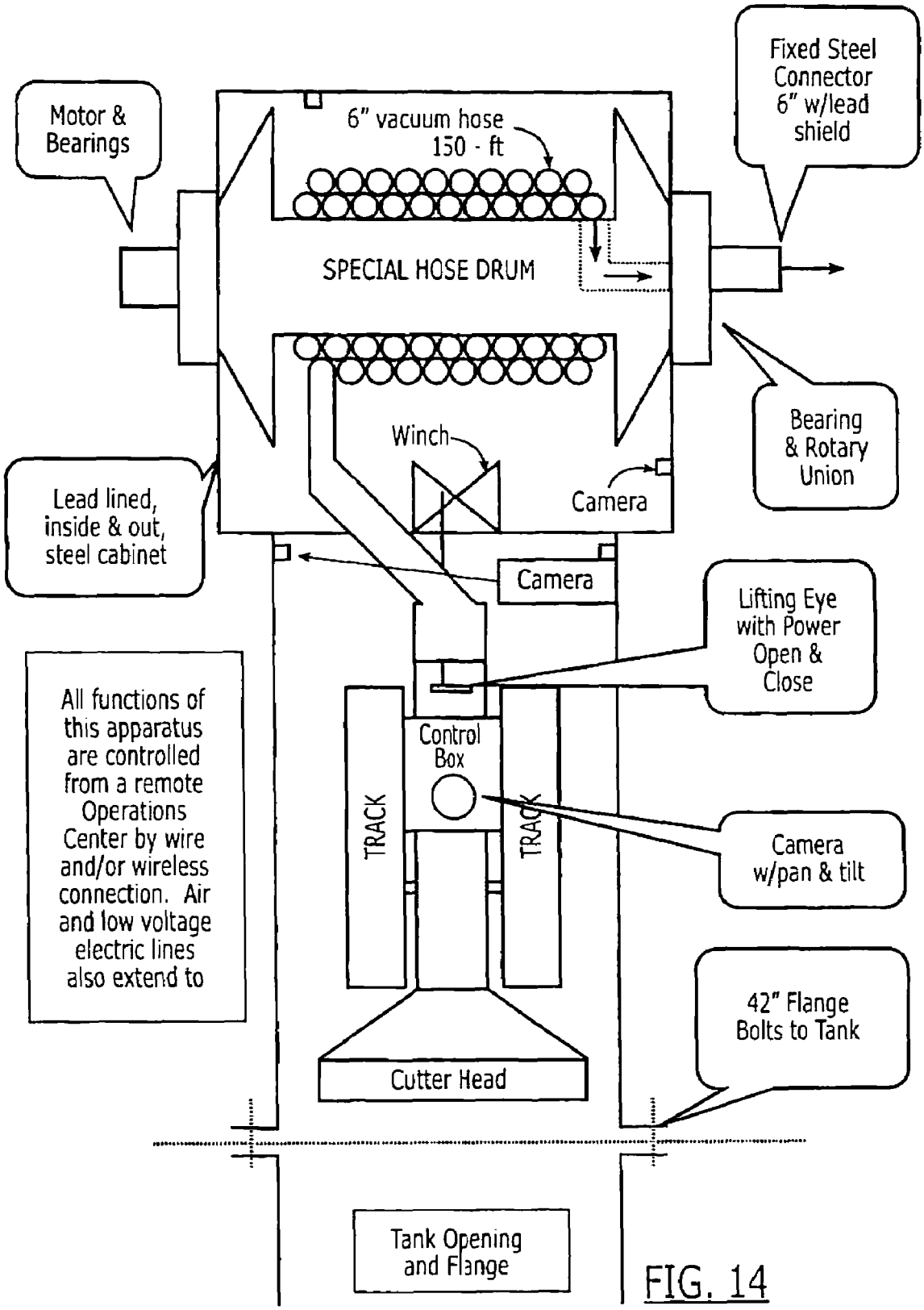
FIG. 14 is a diagrammatical elevation view of one tower embodiment of the present invention operable with the tank illustrated with reference to FIG. 13.

In order to more easily convey the concept of this system we have prepared five diagrams that are attached and numbered so as to assist in referrals. FIG. 13 illustrates a cross-section of the tanks described above showing some more detail of the construction. Please note the one 42 inch manway is the largest and naturally would be the easiest to access with large equipment. All the manways are typically covered with manway covers.

For our new concept several existing technologies are brought together to produce a robotic machine that once it is placed into the tank will not be removed until the cleaning is completed. These existing technologies are centered around the "Resco Hydravator System". This patent pending unit is used by Resco to clean tanks in the Pulp & Paper Industry throughout the Southeastern U.S.

Figure 15:
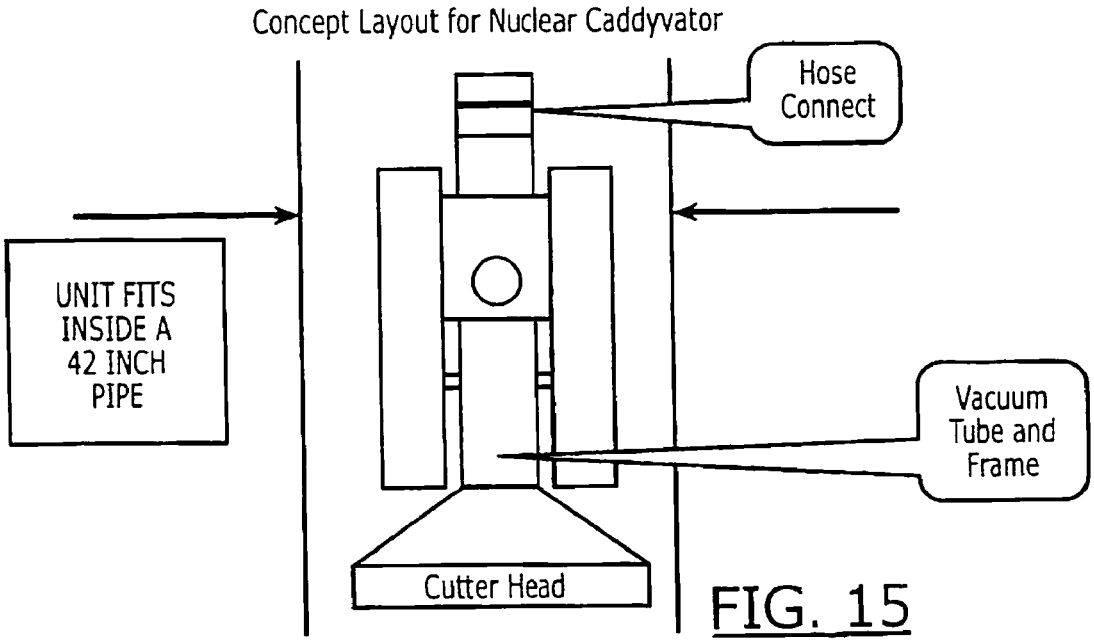
FIGS. 15 and 16 are diagrammatical illustrations of portions of the embodiment of FIG. 14 illustrating features in accordance with the teachings of the present invention.
Figure 16:
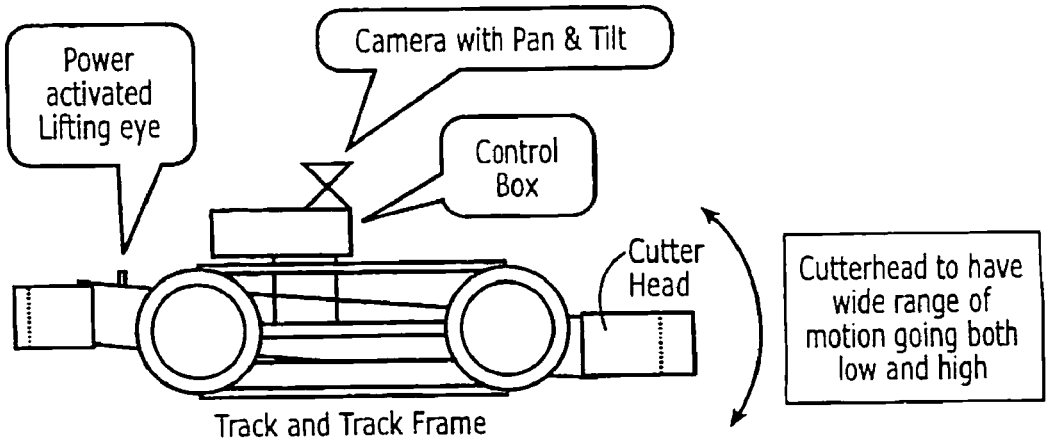
Figure 17:
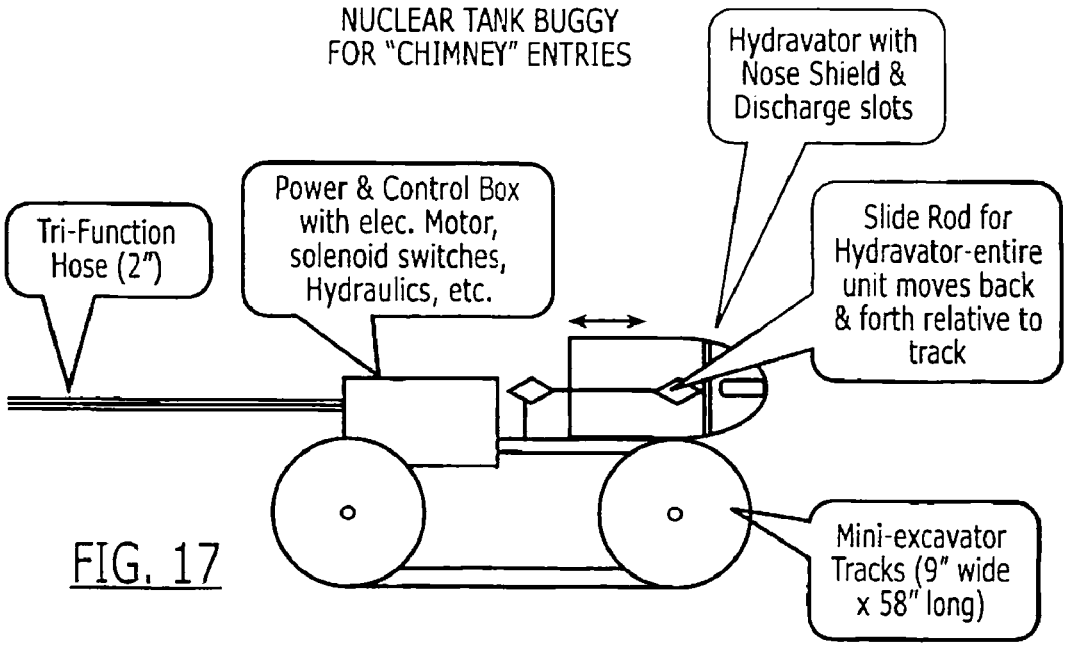
FIGS. 17 and 18 are diagrammatical side and top illustrations of one transport embodiment for a chimney entry accordance with the teachings of the present invention.
Figure 18:
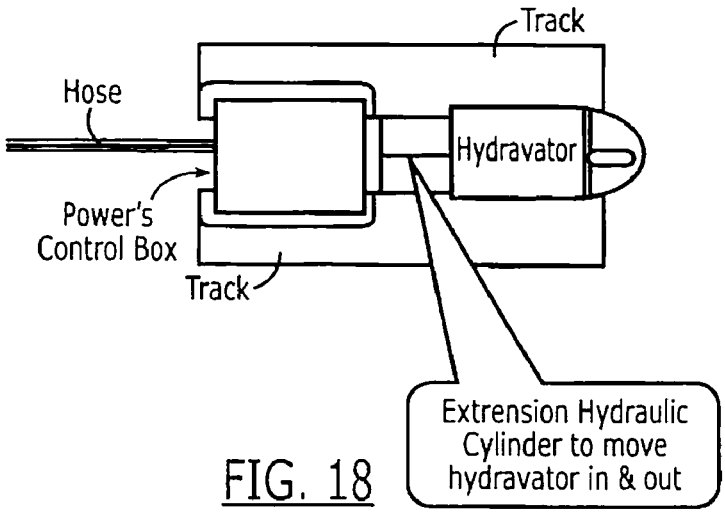
Figure 19:
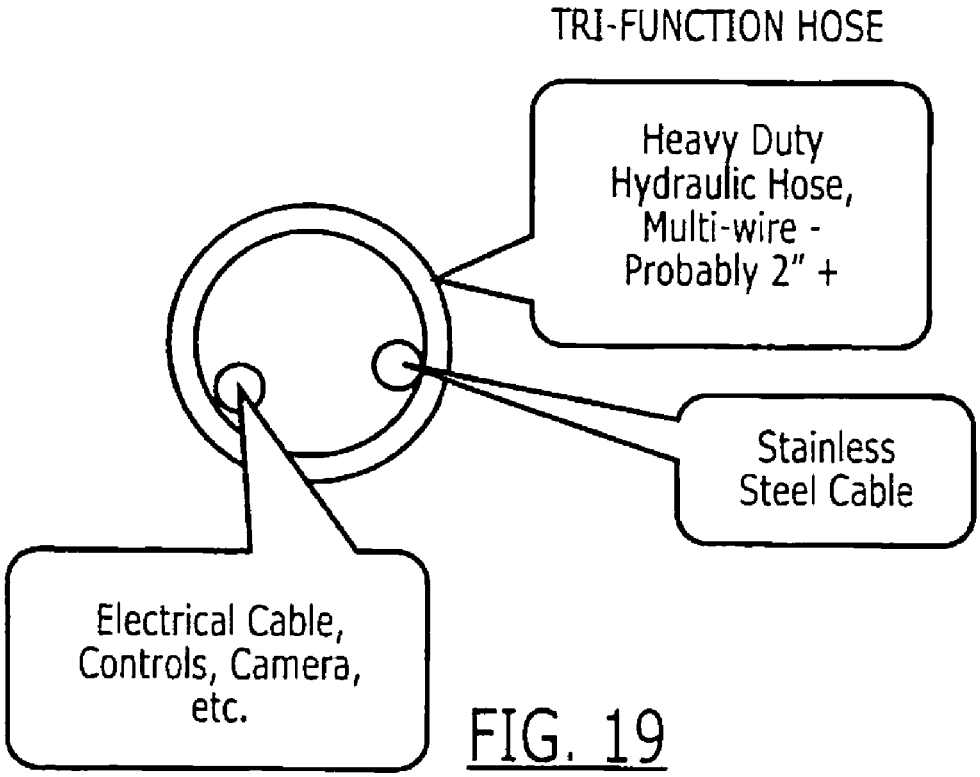
FIGS. 19 and 20 are diagrammatical illustrations of a hose portion of the embodiment of FIG. 17, wherein the hose is operable for transporting water under pressure, electrical signals, and power.
Figure 20:
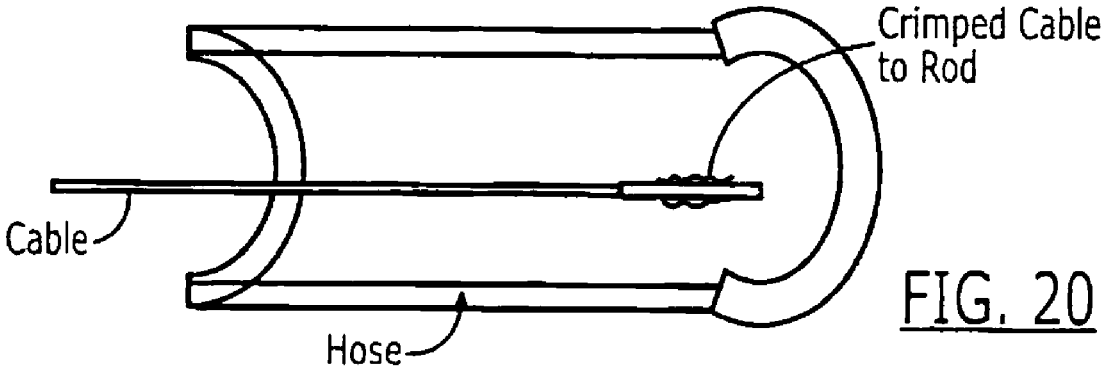

As a simplified explanation, one form of this unit is a tube shaped machine with a rotating cap. This cap has slots at 180 degrees that allow a stream of pressurized liquid to blast out each side. While the cap turns slow 360 degree turns, these liquid blast move from opposing each other forward, toward the end of the cap so as to be blasting in the same direction. Referring to the illustrations in FIG. 15 and FIG. 16, by way of example, for one embodiment of the apparatus 10, is herein referred to as a Hydravator in one format planned for commercial use. As this unit has proven itself in a widespread tank cleaning program it is well suited for this application. Only the carrier or mover is different. Although shown with a track system, hard rubber tires would do the job as well.

Let's assume for a second that the unit is ready to go into this radiated tank environment that would be fatal to a human in a short period. We know that the hydravator will clean the tank by breaking up and washing the sludge to the submersible pump. If we go in the 42" manway we will encounter sludge at the end of the tube preventing further entry. So how do we enter the tank, get the tracks on the floor, and remove the sludge?

With reference again to FIGS. 15 and 16, by way of example, one system is provided. The top unit is a lead lined cabinet that contains two remote powered reels that provide not only lifting and lowering of the equipment, but provide control, power in the way of electricity, and a pressurized water supply. Please notice the 42" flange at the bottom of this cabinet assembly. This flange is designed to bolt up to the 42" flange on the tank once the manway cover is removed. There are additional guides inside the cabinet that provide for the hose and cord to pass trough the flange at one point (each) only. This allows an additional lead shield assembly in the flange area to prevent radiation leaks.

To begin the entry process the Eyehook at the top of the cabinet is attached to a boom truck or crane so the entire assembly can be lifted over the 42" manway.

With the manway bolts removed the cover is removed so the cleaning assembly can be lowered into the manway. The submersible pump is lowered first (being the lowest) and then the Nuclear Buggy goes into the manway and finally the cabinet flange is fitted to the tank matching flange and is bolted together.

There are cameras inside the cabinet to allow monitoring of the mechanical equipment inside, also a camera to view the tube where the pump and Nuclear Buggy are hanging.

To begin operations a remote control room has been set up some distance away to operate the system from. With monitors and controls for all the system components, the pump is first lowered to-the surface of the sludge using the pump reel.

Next, the Nuclear Buggy is lowered to just above the submersible pump. The Hydravator mounted on the Buggy will be in the retracted position. The Hydravator will now be extended effectively lowering it an additional 12" or so. This unit is now placed in the operating mode. This means that the pressurized water is started and the nose assembly, containing the nozzles, begin to rotate continuously working up and down.

When this process has continued for some 10 minutes or so the pump is lowered into the fluidized sludge to start the pumping out of the radiated sludge. This material is pumped to special handling systems provided by the facility.

We continue to lower the Buggy that holds the Hydravator and the pump until a sizeable hole has accumulated and the floor is exposed.

At this point the water flow is stopped and the Hydravator is retracted. This allows the Buggy to slowly be lowered until the tip of the tracks touch the floor. As the Buggy is lowered further the tracks are activated forward to place the Buggy on the floor in an operating position. The Hydravator is extended so the unit is, once again, ready to start.

The submersible pump will remain in it's position for the duration of the cleaning process. The Buggy is used to position the Hydravator over the floor of the tank breaking up the sludge and diluting with water to fluidize into a pumpable solution. This is accomplished by the continued washing of the materials to the pump for removal from the tank. From the small area cleaned under the 42" manway an ever increasing circle is washed to the pump. The operator will keep adequate tri-function hose in the tank to allow free movement of the Buggy in fluidization. From time to time some of the hose may be retracted for operations.

From the control center the operator will monitor the progress with the visual image from the cameras on the Buggy. From time to time he will need to "squirt" the camera lens with water from the system, as provided, to keep a clear picture. The terminology given these cameras by the industry is "hardened" to withstand the radiation of the inter tank environment.

In this general manner all the solids in the tank will be moved to the pump and removed from the tank. Removal of the equipment will be the reverse of the introduction. Some special wash may be used-on the equipment to dilute the radiation before moving it to the next tank. However, at some point the equipment will be shipped with the contaminated waste for permanent disposal.

In the field of industrial cleaning that includes tanks, processing machinery, pits, open areas and in some cases spills the "Vacuum Truck" has become a basic tool, maybe a requirement. Over the past 20 years, we have seen this unit made more powerful, versatile, and accepted. Many accessories have become available to increase their usefulness such as special sewer hoses and cleaning nozzles, containment boxes to accept the vacuumed product, dumping & elevating vacuum truck tanks, etc.

While it is quite common for a user to spend up to $250,000 for a Vacuum Truck and have all types of up to date equipment outside the tank, inside the tank they are exactly where they were to start with. A vacuum hose with a stick taped to it with masking tape and maybe a pick, shovel, and rake round out the "in tank" equipment.

We believe that implementation of the Caddyvator concept will change this. This "breakdown" unit will easily fit through a 24" manway and quickly reassemble inside the tank to provide a quicker and easier way to better utilize this expensive Vacuum Truck. We foresee the use of these units outside the tank in certain situations as well as a "strictly riding" larger version of this concept.

The beauty of the vacuum concept has always been that once the product enters the hose it is out of the tank quickly. The problem has been getting the material broken up and feeding it to the vacuum hose. For the most part the power of the vacuum is not being used because the manual process is so slow. On the other hand, by using the Caddyvator the operator will be able to ride rather than walk, let the machine breakup and feed the material to the vacuum hose, push a button to allow the hose to "breath", and have a steady flow of material to the vacuum hose resulting in increased production.

There are a number of features of the Caddyvator that will need an explanation in order to provide better understanding. The pictures of the prototype enclosed will help with this. These features are listed below with a brief explanation.

The power source of the prototype is pneumatic although it could be hydraulic, electric, or other.

The cutterhead assembly is driven by a single chain. The teeth breakup and thrust the product over a skiver blade that is in contact with the floor the full width of the cutterhead. From here, the product passes through an adjustable "door" that restricts the air-flow through the head to an area approximately equal to the area of the cross-section of the vacuum hose. In addition, the cutterhead has blades on each end that are open (flippers) and do not place the material in the vacuum stream. The flippers thread into the cutterhead shaft. The right side is a left-hand thread and the left side is a right-hand thread such that the direction of blade travel tightens the thread as the unit operates. These blades cut out the material to allow the header to penetrate the resistance of the material.

Behind the cutterhead shaft and teeth, a circular steel piece surrounds the back of the blade except for an opening of about 1.5 inches across the bottom (see enclosed sketch). A door of some 1.5 inches in height is hinged across this steel surround. This door is controlled by an adjustable bolt that can close the suction gap (increasing vacuum by restricting the area) as much as necessary should additional suction be required.

A vital part of the successful use of a vacuum hose is allowing the hose to "breath". This allows free air into the hose and helps clear all material from the hose. Air is the medium by which the product is transferred and so must be applied frequently during the vacuuming process. To provide for this we have two mechanisms that provide air to the hose system.

A manually adjusted door is located on the top of the cutterhead casing. This door can be set to allow a fixed volume of air to enter the cutterhead at all times. This will be determined and set by the operator.

In addition, a door flap is located on top of the pipe at the exit to the cutterhead (it could be located at a number of locations). This steel flap (door) is controlled by an air cylinder that opens and closes quickly. A pushbutton on the control bar opens the door and when the button is released the door closes under pressure.

A sulky is provided to allow the operator to ride on the self-propelled unit. With the sometimes hot environment of the interior tank this helps insure productivity by the operator. Also, the sulky allows the hose to pass through its center for support, pulling the hose around the tank while cleaning. A hose support rod extends some 2-3 feet behind the sulky to keep the hose out of the way when the machine reverses. Also, we envision installing a safety valve that is activated by the seat. When the operator sits down the air flow is open to the unit and when he gets off the seat the air is closed to the unit. At times that are dictated by the type material in the tank and the quantity of the buildup, the operator would operate without the sulky. This allows greater maneuverability of the unit to clear out a working area before the sulky is attached. One disadvantage of not using the sulky is that the operator has to walk around the vacuum hose that hooks to the unit.

There are advantages to using air for a power source. First, it is clean and non-sparking. The hose is cheap and much easier to pull as compared to hydraulic hose and cost to operate is lower when all things are considered. Hydraulic oil is a pollutant when leaks develop and the oil spills. A disadvantage is the sound level with the air motors operating. We have vented the discharge back into the vacuum system to reduce decibels. While standard vacuum hoses produce quite a noise from the rushing air this will be a somewhat higher level. Ear plugs or muffs would be recommended to prevent ear damage long-term. Two air feed hoses are seen in these pictures, however, with the proper air valves a single hose will be used.

With regard to underground storage, several locations within the U.S. there are facilities with 50 or more of the type tanks described below. These are carbon steel tanks constructed some 50 years ago. They are bunkered underground surrounded by concrete walls and sub-floors. They are toxic with Alpha, Beta, and Gamma radiating nuclear waste. These tanks are some 85 feet in diameter and contain sludge build-ups of 4-6 feet. Each vertical foot contains 42,445 gallons of sludge. It would be fatal for any human to enter one of these storage areas. Removal of the manway covers on one of these tanks will set off alarms for several miles. As these tank conditions worsen and the leakage increases, management has made the decision to clean the tanks of nuclear contaminated sludge and fill the area with grout. To date complete cleaning of the tanks has not been achieved.

This sludge resembles muddy silt-like textured material and its harmful radiation can last for several hundred years. For this reason, all the contaminated material needs to be removed prior to closing the facility.

For a method of cleaning, by way of example, one machine and system that we have developed is for use with vacuum trucks and systems and has been dubbed "The Caddyvator". The rational for this is that the unit simply serves as a "Caddy" to carry the vacuum hose. Of course, it serves to breakup, shred, introduce cutter stock, and other functions as well.

In the field of industrial cleaning that includes tanks, processing machinery, pits, open areas and in some cases spills the "Vacuum Truck" has become a basic tool, maybe a requirement. Over the past 20 years, we have seen this unit made more powerful, versatile, and accepted. Many accessories have become available to increase their usefulness such as special hoses and cleaning nozzles with hydro-blasters to breakup the products, containment boxes to accept the vacuumed product, dumping & elevating vacuum truck tanks, etc. The beauty of the vacuum concept has always been that once the product enters the hose it is out of the tank quickly. The product can be wet, mushy, or dry. Why not take this popular technology and use it for the most daunting tank cleaning challenge of all time?

With a marriage of the Vacuum and Caddyvator technologies, this can be done.

The addition of thousands of gallons of water that must be evaporated is unnecessary, cleaning of the tanks will be fast and complete, the tank system remaining sealed for all but five minutes of the project, are only a few of the advantages of this system.

The Department of Energy has the monumental task of cleaning up contaminated sites and disposing of radioactive waste left behind as a byproduct of nuclear weapons production, nuclear powered naval vessels and commercial nuclear energy production. DOE must mitigate the risks and hazards posed by the legacy of nuclear weapons production and research. The most ambitious and far ranging of this mission is dealing with the environmental legacy of the Cold War.

Since the early days of weapons production, the U.S. Department of Energy (DOE) has generated, stored and disposed of various types of radioactive wastes. DOE's complex-wide capabilities for radioactive waste treatment, storage, and disposal often require sharing resources. Sites must cooperate and consider both the availability of resources and the life-cycle costs associated with the use of commercial versus DOE resources. The Office of Environmental Management (EM) maintains the Department's waste management policies, assures the availability of these corporate resources, seeks efficiencies in operations, develops solutions to unique circumstances, provides a complex-wide perspective, and addresses regulatory and policy issues.

In the field of industrial cleaning that includes tanks, processing machinery, pits, open areas and in some cases spills the "Vacuum Truck" has become a basic tool, maybe a requirement. Over the past 20 years, we have seen this unit made more powerful, versatile, and accepted. Many accessories have become available to increase their usefulness such as special sewer hoses and cleaning nozzles, containment boxes to accept the vacuumed product, dumping & elevating vacuum truck tanks, etc.

While it is quite common for a user to spend up to $250,000 for a Vacuum Truck and have all types of up to date equipment outside the tank, inside the tank they are exactly where they were to start with. A vacuum hose with a stick taped to it with masking tape and maybe a pick, shovel, and rake round out the "in tank" equipment.

We believe that implementation of the Caddyvator concept will change this. This "breakdown" unit will easily fit through a 24" manway and quickly reassemble inside the tank to provide a quicker and easier way to better utilize this expensive Vacuum Truck. We foresee the use of these units outside the tank in certain situations as well as a "strictly riding" larger version of this concept.

The beauty of the vacuum concept has always been that once the product enters the hose it is out of the tank quickly. The problem has been getting the material broken up and feeding it to the vacuum hose. For the most part the power of the vacuum is not being used because the manual process is so slow. On the other hand, by using the Caddyvator the operator will be able to ride rather than walk, let the machine breakup and feed the material to the vacuum hose, push a button to allow the hose to "breath", and have a steady flow of material to the vacuum hose resulting in increased production.

By way of example for one commercialized embodiment of the tank cleaning apparatus 10 above described and herein referred to as the Caddyvator system, the restrictor plate 56 plays a desirable role. For the vacuum system 10 to do its job, the vacuum must be maintained to the point of contact with the material. With a 6" vacuum hose, for example, the cross-section is 28.27 square inches. The cutterhead proper, the area exposing the cutting teeth 26 measures 20"×6" or 120 square inches. With this much area the vacuum would be reduced to an ineffective level. Therefore, the restrictor plate 56 is closely contoured to the radius of the cutterhead 12 and only allows about 1.25" opening under the 20" cutterhead and the skive blade 42/bottom. This opening can be reduced further if necessary.

As mentioned above a look at the pictures will help understand the physical appearance of these features on the prototype. Also, I have a few things covered with diagrams to assist in understanding.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of claims supported by this disclosure.

The invention claimed is:

1. An apparatus comprising:

a cutter head assembly including a housing having a cutting bar disposed at a forward end thereof, the cutting bar having a transversely mounted center shaft provided with a plurality of spaced apart cutting teeth disposed across a lateral extent of the center shaft;

an arcuate shroud carried within the housing adjacent the cutting bar for controlling a flow of material being cut by the cutting teeth;

a restrictor plate hingedly secured to the shroud within the housing such that edges of the restrictor plate are closely spaced from inside walls of the housing, the restrictor plate forming a throat within the housing such that a cross-sectional area is formed through which material from the cutting bar is moved; and a vacuum assembly operable with the housing proximate the throat for removing the material therefrom, wherein the housing includes an aperture extending through an upper portion of the housing for providing a venting thereto, the housing further comprising a door pivotally mounted proximate the aperture and moveable thereacross for adjusting the venting of air with the housing, wherein the venting controls an amount of air flow entering the housing and affecting the vacuum assembly in removing the material.

2. The apparatus according to claim 1, further comprising a propulsion assembly supporting the cutter head assembly for providing a controlled movement thereto.

3. The apparatus according to claim 1, wherein the vacuum assembly comprises a tube extending from the housing at one end to an opening at an opposing end adapted for receiving a vacuum hose.

4. An apparatus comprising:

a cutter head assembly including a housing having a cutting bar disposed at an end thereof, the cutting bar having a center shaft provided with a plurality of spaced apart cutting teeth disposed across the center shaft;

a shroud carried within the housing adjacent the cutting bar for controlling a flow of material being cut by the cutting teeth;

a restrictor plate operable with the shroud such that edges of the restrictor plate are closely spaced from inside walls of the housing, the restrictor plate forming a throat within the housing such that a cross-sectional area is formed through which material from the cutting bar is moved; and a vacuum assembly operable with the housing for removing the material therefrom, wherein the vacuum assembly comprises a tube extending from the housing at one end to an opening at an opposing end adapted for receiving a vacuum hose, and wherein the tube comprises an opening therein and a flap operable with the opening for adjusting a venting of air with the vacuum assembly.

5. The apparatus according to claim 4, further comprising an actuator operable with the flap for providing a movement thereto.

6. The apparatus according to claim 1, wherein the plurality of spaced apart cutting teeth disposed across the lateral extent of the center shaft are arranged in a preselected pattern comprising one of helical, double helical and random.

7. The apparatus according to claim 1, further comprising flipper blades rotatable by the shaft and carried external to the housing.

8. The apparatus according to claim 1, wherein a material access opening of the housing having the cutting blades operating therein includes a shiver blade defining a lower edge thereof.

9. The apparatus according to claim 1, further a cutting motor operable with the cutting bar for a driving thereof, the cutting motor carried by the housing.

10. An apparatus useful in cleaning an interior of storage tanks, the apparatus comprising:

a housing having a front opening and an opposing rear opening;

a cutter head carried by the housing proximate the front opening, the cutter head operable for receiving material to be processed at a forward portion thereof;

a shroud carried within the housing adjacent a rear portion of the cutter head, the shroud controlling a direction of flow for the cut material;

a restrictor plate operable with the shroud such that edges of the restrictor plate are closely spaced from interior walls of the housing, the restrictor plate adjustable with respect to at least one wall of the housing for forming a throat having a preselected cross sectional area for movement of the cut material through the throat and rear opening; and a vacuum assembly operable with the rear opening of the housing, the vacuum assembly operable with a vacuum source for vacuuming the material therefrom, wherein at least one of the housing and the vacuum assembly includes an adjustable aperture extending through an upper portion thereof for providing a venting thereto, and wherein the venting affects an amount of air flow entering the housing and thus the vacuuming of the material.

11. The apparatus according to claim 10, wherein the restrictor plate is hinged to the shroud, the apparatus further comprising an adjustment device operably connected to the restrictor plate for providing an adjustment thereto.

12. The apparatus according to claim 10, wherein the cutter head comprises a cutting bar having a shaft transversely mounted to the housing and a plurality of spaced apart cutting teeth disposed across a lateral extent of the shaft, and wherein the cutting teeth are arranged in a preselected pattern comprising one of helical, double helical and random orientation.

13. The apparatus according to claim 12, further comprising flipper blades rotatable by the shaft and carried external to the housing.

14. The apparatus according to claim 10, wherein the front opening of the housing comprises a shiver blade defining a lower edge thereof.

15. The apparatus according to claim 10, further comprising a propulsion assembly supporting the cutter head assembly for providing a controlled movement thereto.

16. The apparatus according to claim 10, wherein the vacuum assembly comprises a tube at an exhaust end adapted for receiving a vacuum hose.

17. An apparatus comprising:

a housing having opposing first and second openings therein;

a cutter head carried by the housing proximate the first opening;

a shroud carried within the housing proximate the cutter head for controlling a direction of flow of material entering the housing;

a restrictor plate operable with the shroud and forming a throat through which the material flows; and a vacuum assembly operable with the second opening of the housing, the vacuum assembly operable with a vacuum source for vacuuming the material therefrom, wherein at least one of the housing and the vacuum assembly includes an adjustable aperture extending through a wall thereof for providing a venting thereto, and wherein the venting affects an amount of air flow entering the housing and thus the vacuuming of the material.

18. The apparatus according to claim 17, wherein the restrictor plate is closely spaced from an interior wall of the housing, the restrictor plate adjustable with respect to the wall for forming the throat into a preselected cross sectional area.

19. The apparatus according to claim 17, wherein the vacuum assembly comprises a tube extending from the housing at one end to an opening at an opposing end adapted for receiving a vacuum hose.

20. The apparatus according to claim 17, further comprising an actuator operable with the adjustable aperture for providing an adjustment thereto.

* * * * *